United States Patent [19]

Parker et al.

[11] 4,404,792

[45] Sep. 20, 1983

[54] FRICTION SPINNING APPARATUS

[76] Inventors: Alan Parker, 7 Darvel Close, Breightmet, Bolton, Lancashire; Douglas O. Clough, 26 Parkwood Dr., Rawtenstall, Rossendale, Lancashire, both of England

[21] Appl. No.: 349,541

[22] Filed: Feb. 17, 1982

[30] Foreign Application Priority Data

Feb. 21, 1981 [GB] United Kingdom ..... 8105573

[51] Int. Cl.[3] ..... D01H 1/12; D01H 7/892

[52] U.S. Cl. ..... 57/401; 57/5; 57/413

[58] Field of Search ..... 57/5, 400, 401, 408, 57/411, 413, 415

[56] References Cited

U.S. PATENT DOCUMENTS 4,130,983 12/1978 Dammann et al. ..... 57/5
4,202,163 5/1980 Turk et al. ..... 57/411 X
4,222,222 9/1980 Didek et al. ..... 57/5
4,249,368 2/1981 Fehrer ..... 57/5
4,281,507 8/1981 Didek et al. ..... 57/411
4,327,545 5/1982 Fehrer ..... 57/401 X
4,362,008 12/1982 Parker et al. ..... 57/401 X

*Primary Examiner*—Donald Watkins
*Attorney, Agent, or Firm*—Donald H. Feldman

[57] ABSTRACT

A friction spinning apparatus comprises two rollers in closely spaced parallel arrangement which define between them a yarn formation zone at an elongate gap along the rollers and a feed duct which extends into the gap so as to feed fibres directly into the gap in such a manner that they can fall directly onto the yarn. The feed duct is biassed slightly toward the roller which turns into the gap so as to increase the proportion of fibres joining the yarn at the junction with that roller.

8 Claims, 2 Drawing Figures

FRICTION SPINNING APPARATUS

This invention relates to apparatus for open-end spinning yarn and particularly to apparatus of the type known as friction spinning.

Apparatus of this type has been proposed previously in many publications. One specific example is shown in British Published Application No. 2,042,599 and comprises two rotatable bodies each providing a surface and arranged such that the surfaces define between them an elongate gap which narrows towards a line of closest approach of the surfaces, means for rotating one of the bodies in a direction such that its surface moves into the gap and the other body such that its surface moves out of the gap to twist the fibres in the gap to form a yarn, means for withdrawing the yarn along the gap, and a fibre feed duct arranged to feed fibres substantially directly into the gap such that some fibres can fall directly on to the yarn.

Apparatus of this type has also been disclosed in a number of patent specifications by Dr. Ernst Fehrer for example published British Application No. 2,022,152 and have achieved some commercial success. However improvement in yarn quality is an ongoing and fundamental requirement to ensure the widest commercial acceptability of the yarns from the apparatus. In these prior apparatus, the fibres are fed substantially symmetrically on to the two bodies or rollers and this has always been an accepted principle in apparatus of this type to maintain the symmetry of the system.

In an alternative line of development arising from British Pat. No. 1,231,198 (TMM) and followed up in FIG. 2 of U.S. Pat. No. 4,130,983 (Barmag) and for example U.S. Pat. No. 4,222,222 (Didek et al assigned to V.U.B.) the fibres are fed directly on to the one of the surfaces which turns into the gap in a manner which prevents fibres falling directly onto the yarn end such that the fibres are deposited on the surface first and carried into the gap on the surface.

This arrangement has been considered unsatisfactory because it does not allow the proper orientation of the fibres achieved in the feed duct to be communicated directly into the yarn structure and hence workers have turned away from this arrangement to the symmetrical arrangement outlined above and it has effectively been abandoned.

The objective of the present invention is therefore, arising from the presently accepted symmetrical feed arrangement outlined above, to obtain an improvement in yarn quality by a modification to that arrangement.

Accordingly the invention is characterized in that the fibre feed duct is biassed to one side so as to tend to direct more of the fibres toward the surface which moves into the gap.

One embodiment of the invention will now be described in more detail in the following description when taken together with the accompanying drawing in which.

Figure 1:
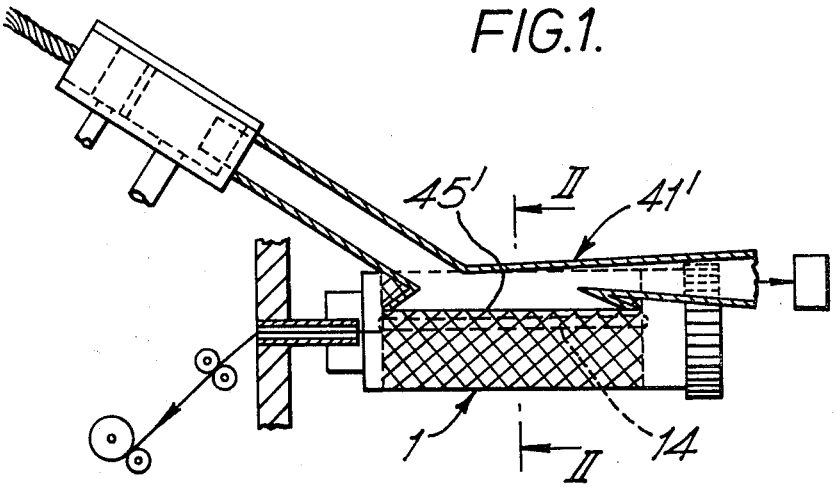
FIG. 1 is taken from Published British Application No. 2,042,599 and shows schematically a friction spinning apparatus of this type.
Figure 2:
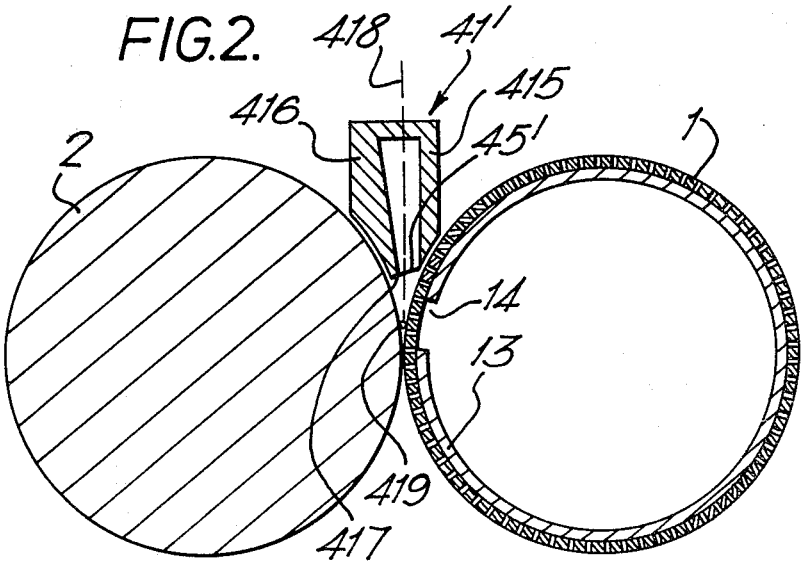
FIG. 2 is an enlarged section on the lines II—II of FIG. 1 showing the modified apparatus according to this invention.

Referring firstly to FIG. 1, the structure and operation of this apparatus is fully disclosed and described in Published British Application No. 2,042,599 and those unfamiliar with this apparatus should refer to that specification for a detailed description of the apparatus. The apparatus described therein has been modified according to the present invention by the provision of a feed duct 41' as shown in FIG. 2. The reference numerals used in the following description where possible are the same as used in the above specification.

The duct 41' extends to an elongate mouth 45' positioned closely adjacent and parallel to the line of closest approach of the rollers 1 and 2, that is it extends into the narrowing gap between the rollers to a position closer to the line of closest approach than the radius of curvature of the rollers. In practice the mouth 45' is spaced less than 10 mms from the yarn formation position which in turn is spaced from the line of closest approach by 2 or 3 mms.

The duct 41' is formed in two parts, that is one plane flat wall 415 which extends vertically and one wall 416 which is complex in shape as including a taper toward the mouth 45' and all structural parts necessary to cooperate with the flat wall 415 to form the complete feed duct 41'.

As described in the above published application, the roller 1 is perforated and includes a suction duct 13 inside including a narrow slot 14 along the length of the rollers to define a narrow elongate area on the roller 1 through which air is drawn. The roller 2 is imperforate. The roller 1 rotates in a direction such that observed from the side of the feed duct 41' it moves into the gap and the roller 2 moves in the same rotational sense such that it moves out of the gap.

The duct 41' thus, as disclosed in Published British Application No. 2 042 599 is arranged to feed the fibres substantially directly into the gap such that some can fall directly onto the yarn. It will be appreciated that it is very difficult if not impossible to determine exactly where the fibres are deposited, but it is clear that this arrangement is different from one wherein the fibres are clearly aimed and directed at the wall of one of the rollers, and are prevented from directly falling onto the yarn.

The duct of the present invention is however modified such that the mouth is biassed to the side adjacent the perforated roller 1. More specifically the mouth 45' opens such that one side lies substantially immediately adjacent the roller 1 while a spacer surface 417 lies between the other side and the roller 2. Of the total mouth width of the order of 75% lies on the side of the central plane (shown at 418) adjacent the roller 1. The inner surface of the wall 416 includes all the taper of the feed duct and is directed such that an extension would intersect the yarn (shown at 419) or the junction of the yarn 419 and the roller 1. The duct may be more biassed than as shown in FIG. 2, but not so far that fibres are prevented from falling directly onto the yarn. The side of the mouth adjacent the roller 2 lies on the same side of the central plane 418 as the roller 2.

In this way the duct 3 tends to direct more of the fibres, than would be the case with the prior arrangements, toward the roller 1. As explained above it is not possible to determine exactly how many fibres are deposited on a particular area but it is clear that the duct has a tendency to direct more fibres toward the roller 1 than toward the roller 2. In addition it should be noted that because the whole of the taper lies in the wall 6, more of the fibres will be travelling on that side of the duct.

An explanation for the improved performance cannot be given with certainty because of the difficulty of determining the exact path of fibres but it is believed that the following occurs. A larger proportion of fibres thus are aimed to join the yarn at or adjacent its junction with the roller 1 and a smaller proportion of fibres join the yarn at the junction between the yarn and the roller 2. Some fibres may first encounter the surface of the roller 1, but they do so at a very shallow angle and for a very short distance and hence their orientation is very little affected by their contact with the roller before they encounter and join the yarn. Fibres which join at the roller 1 are it is believed rolled between the yarn and the roller 1 and hence join the yarn smoothly. Fibres which join at the roller 2 firstly are flung around the upper surface of the yarn by the rotation of the yarn and hence do not join into the yarn as smoothly as those at the roller 1.

We claim:

1. In an apparatus for open-end spinning yarn of the type comprising two rotatable bodies each having a surface and arranged such that the surfaces define an elongate gap which narrows toward a line of closest approach of the surfaces, means for rotating one of the bodies in a direction so that the surface moves into the gap and means for moving the other body in a direction so that the surface moves out of the gap to twist fibres in the gap to form a yarn, means for withdrawing the yarn along the gap, and a fibre feed duct having an elongate mouth within the gap and arranged to feed fibres substantially directly into the gap such that some fibres can fall directly on to the yarn, the improvement wherein the fibre feed duct is biassed to one side so as to tend to direct more of the fibres toward the surface which moves into the gap.

2. The improvement according to claim 1, wherein the surface which moves into the gap is perforated and the surface which moves out of the gap is imperforate.

3. The improvement according to claim 1, wherein the feed duct tapers in one plane toward the elongate mouth, one wall of the feed duct is flat and all the taper is formed by the opposite wall.

4. The improvement according to claim 3, wherein the flat wall ends adjacent the surface which moves into the gap.

5. The improvement according to claim 4, wherein the flat wall is substantially at right angles to the plane containing the axes of rotation of the bodies.

6. The improvement according to claim 1, wherein the elongate mouth lies less than 10 mms from the yarn.

7. The improvement according to claim 1, wherein part of the elongate mouth lies on either side of plane passing through the yarn and perpendicular to the plane containing the axis of rotation of the bodies.

8. The improvement according to claim 1, wherein one side of the elongate mouth lies substantially immediately adjacent the surface which moves into the gap.

* * * * *